US008506312B2

(12) United States Patent
Li et al.

(10) Patent No.: US 8,506,312 B2
(45) Date of Patent: Aug. 13, 2013

(54) CARD EDGE CONNECTOR WITH IMPROVED EJECTOR MECHANISM

(75) Inventors: Zhuang-Xing Li, Kunshan (CN); Wen-Jun Tang, Kunshan (CN); Xue-Wu Bu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/285,158

(22) Filed: Oct. 31, 2011

(65) Prior Publication Data

US 2012/0108092 A1 May 3, 2012

(30) Foreign Application Priority Data

Nov. 1, 2010 (CN) ..... 2010 2 0587041

(51) Int. Cl.
*H01R 13/62* (2006.01)

(52) U.S. Cl.
USPC ..... 439/159

(58) Field of Classification Search
USPC ..... 439/157, 159, 327–329, 160; 361/737
See application file for complete search history.

(56) References Cited

U.S. PATENT DOCUMENTS

| | | | | |
|---|---|---|---|---|
| 5,429,523 | A * | 7/1995 | Tondreault | 439/157 |
| 5,511,985 | A * | 4/1996 | Noschese et al. | 439/157 |
| 5,662,485 | A * | 9/1997 | Yip et al. | 439/157 |
| 5,957,708 | A * | 9/1999 | Lin | 439/157 |
| 6,132,228 | A * | 10/2000 | Lang | 439/160 |
| 6,319,027 | B1 * | 11/2001 | Pickles et al. | 439/157 |
| 7,233,500 | B2 * | 6/2007 | Yu | 361/737 |
| 7,645,150 | B1 * | 1/2010 | Chang | 439/157 |
| 7,708,599 | B2 | 5/2010 | Guan et al. | |
| 2007/0093097 | A1 * | 4/2007 | Guan et al. | 439/157 |
| 2012/0108092 | A1 * | 5/2012 | Li et al. | 439/159 |

* cited by examiner

*Primary Examiner* — Alexander Gilman
(74) *Attorney, Agent, or Firm* — Wei Te Chung; Ming Chieh Chang

(57) ABSTRACT

A card edge connector includes an elongated housing, the housing extends along a longwise direction thereof and has a pair of opposed side walls, a central slot between the side walls, and a tower portion disposed at one end thereof. A plurality of contacts are retained in the housing. An ejector mechanism is rotatable retained in the housing and has a body portion, a flexible arm divided from the body portion and a locking protrusion located on the flexible arm. The lock protrusion is adapted to resist the tower portion during the ejector mechanism rotates with respect to the housing.

15 Claims, 7 Drawing Sheets

CARD EDGE CONNECTOR WITH IMPROVED EJECTOR MECHANISM

BACKGROUND OF THE INVENTION

1. Field of the Invention

The present invention relates to card edge connectors, more particularly to a card edge connector with an improved ejector mechanism.

2. Description of Related Art

Card edge connectors are employed widely in computers to receive a memory card, graphic card, network interface et al. The card edge connector as described in U.S. Pat. No. 7,708,599B2 has an elongated housing, a plurality of contacts retained in the housing for electrically connecting a corresponding memory card, and a pair of ejector mechanisms attached at two opposited ends of the housing for locking the memory card. The housing has a pair of side walls, a central slot between the side walls for receiving the memory card, and a pair of tower portions at two ends thereof. The tower portions each defines a pair of retention walls opposited to each other in a width direction of the housing, and a retaining cavity disposed between the retention walls to rotatably retain the ejector mechanism therein. The ejector mechanism usually includes a main body, a locking head inwardly extending from the main body along a lengthwise direction of the housing to lock with the memory card, an operating portion opposite to the locking head in the lengthwise direction, and an ejecting portion inwardly extending from a lower end of the body portion to be under the central slot for pushing the memory card out from the central slot.

The body portion has a pair of projections formed on two lateral outer surfaces thereof to press onto the corresponding retention walls while the memory card is inserted into central slot. Thus, the ejector mechanism does not easily rotate for the memory card is locked in the card edge reliably. However, the projections of the ejector mechanism are easily abrade as the projections are rigidly contact with the retention walls of the tower portion while the card edge connector is in use for long-time.

Hence, an improved card edge connector is desired to overcome the above problems.

BRIEF SUMMARY OF THE INVENTION

According to one aspect of the present invention, A card edge connector comprises: an elongated housing extending along a longwise direction thereof and having a pair of opposed side walls, a central slot between the side walls for receiving a memory card, and a tower portion disposed at one end thereof, the tower portion defining a pair of retention walls opposited to each other in a width direction to define a retaining cavity therebetween; a plurality of contacts retained in the housing and exposed to the central slot; and an ejector mechanism rotatable retained in the retaining cavity, the ejector mechanism having a body portion, an operating portion and a locking head oppositely extending from a top end of the body portion in the lengthwise direction, respectively, and an ejecting portion inwardly extending from the body portion, wherein the body portion has a flexible arm, and a locking protrusion located on the flexible arm and outwardly resisting the retention wall during the ejector mechanism rotating with respect to the housing.

According to another aspect of the present invention, a card edge connector for receiving a memory card, comprises: an elongated housing defining a central slot extending along a lengthwise direction thereof, and two tower portions located at two opposite ends thereof; two rows of contacts disposed by two sides of the central slot, respectively; a pair of ejector mechanisms rotatably disposed in the corresponding tower portions, respectively, each of the ejector mechanisms defining at least one flexible arm extending in the lengthwise direction, and at least one locking protrusion located on the flexible arm and extending toward a first direction perpendicular to the lengthwise direction; and a pair of stop blocks formed in the tower portion and extending toward a second direction opposite to the first direction and perpendicular to the lengthwise direction, the stop blocks being disposed at two opposited lateral outsides of the ejector mechanism; wherein the flexible arm is configured with enough deflection to allow the locking protrusion to pass the stop block in the lengthwise direction when the ejector mechanism is rotated to an upstanding position.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
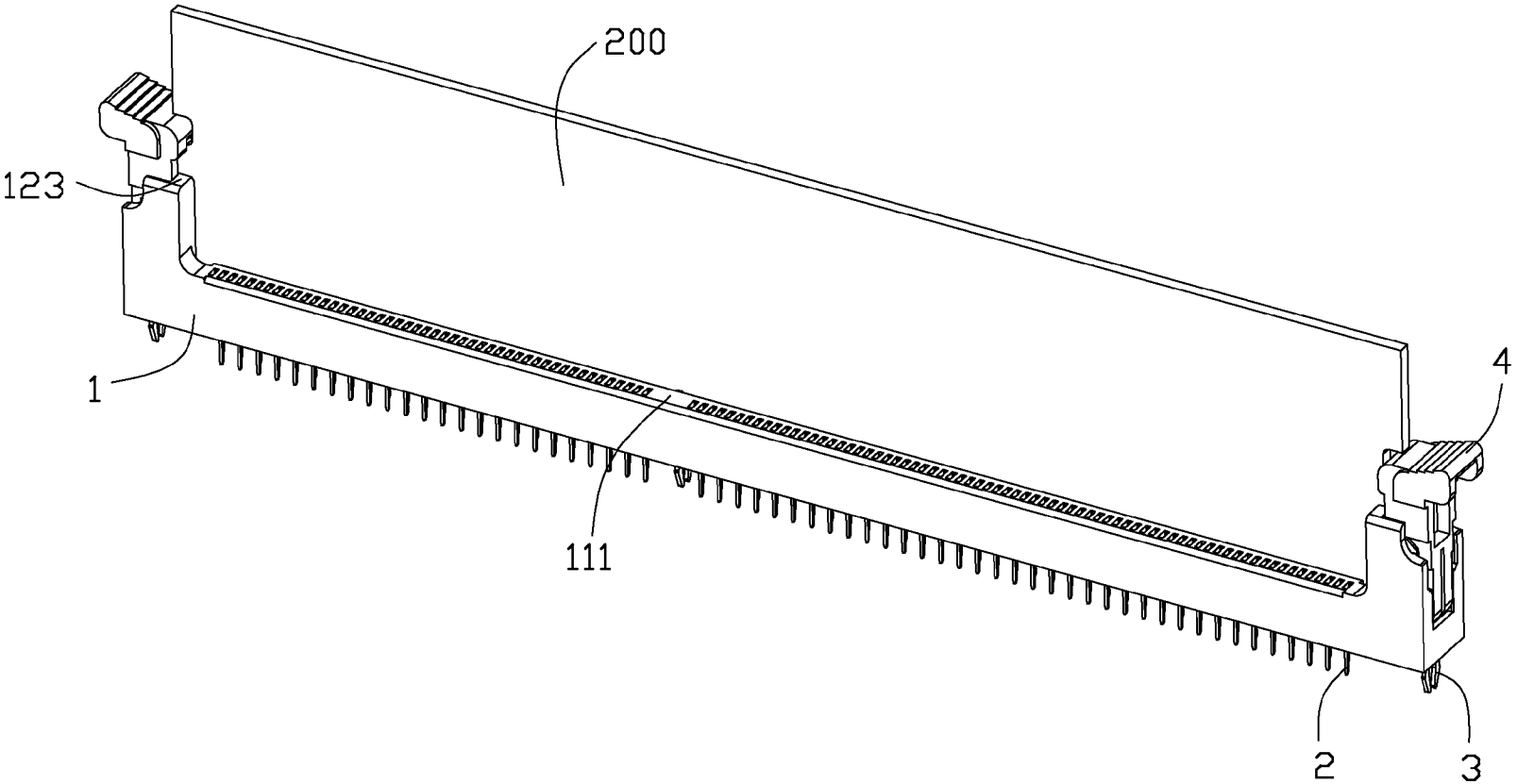
FIG. 1 is a perspective view of a card edge connector according to the present invention with a memory card inserted thereinto.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
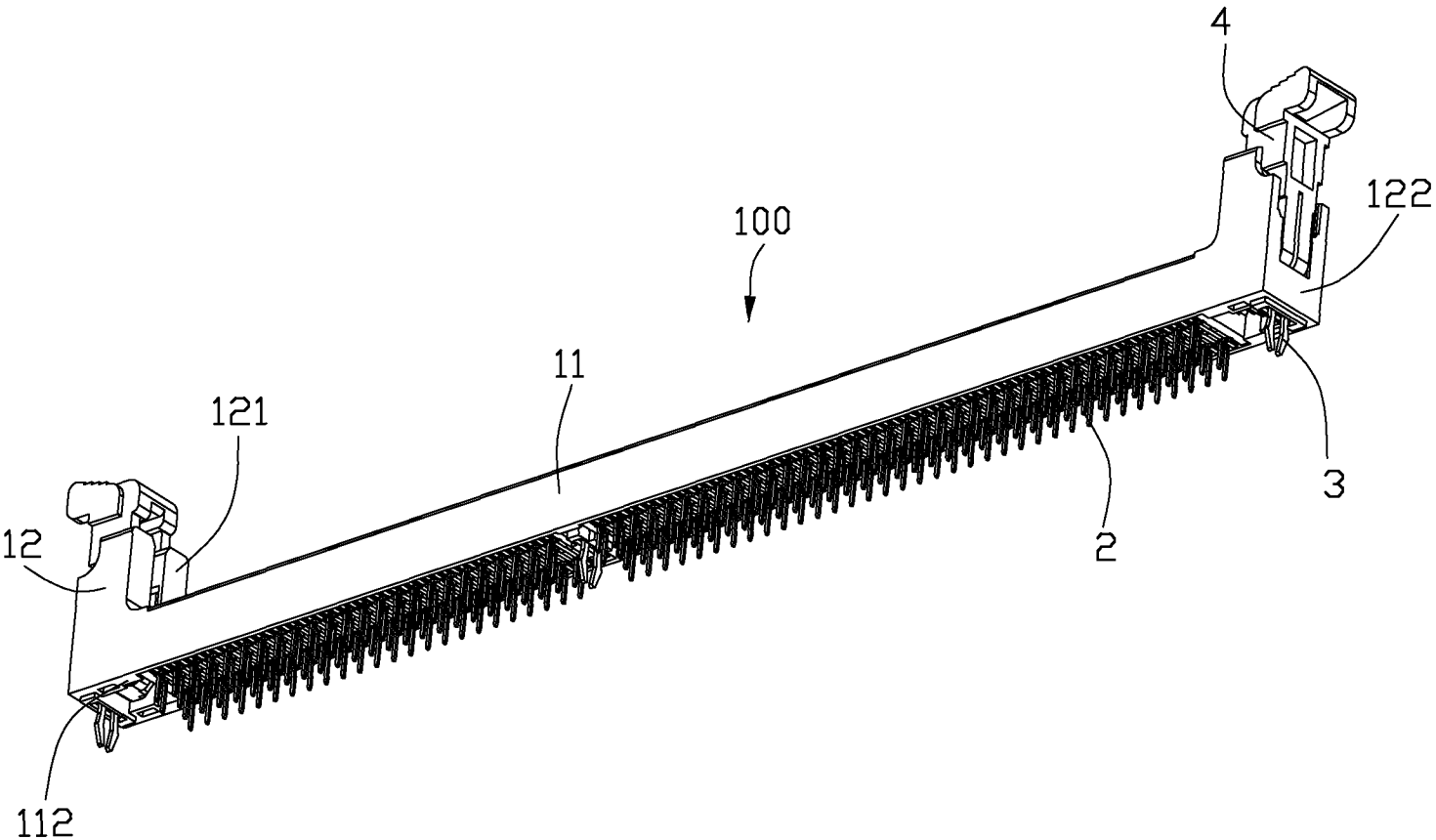
FIG. 2 is another perspective view of the card edge connector shown in FIG. 1.

Referring to FIGS. 1-2, a card edge connector 100 for mating with a memory card 200 according to the present invention is disclosed. The card edge connector 100 includes an elongated housing 1, a plurality of contacts 2 retained in the housing 1, two board locks 3 retained at a bottom of the housing 1 for mounting the card edge connector 10 onto a mother board (not shown), and a pair of ejector mechanism 4 disposed on two ends of the housing 1.

Figure 3:
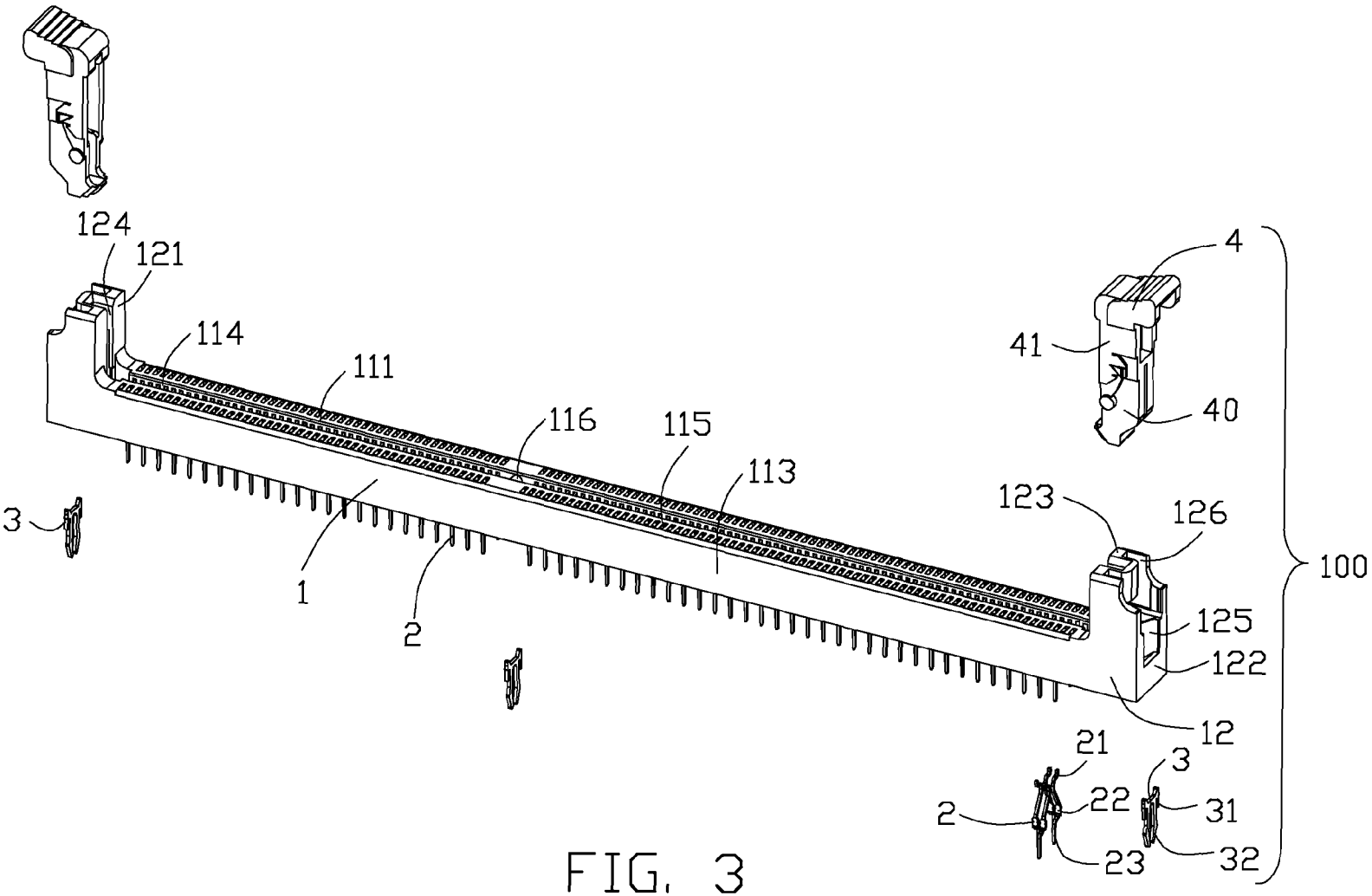
FIG. 3 is partly exploded view of the card edge connector shown in FIG. 1.
Figure 4:
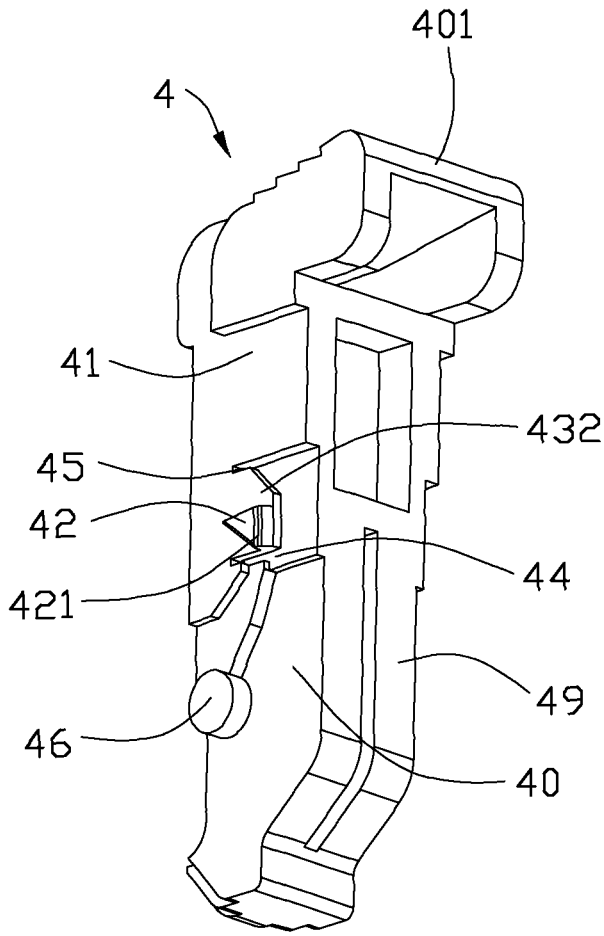
FIG. 4 is perspective view of an ejector mechanism of the card edge connector shown in FIG. 1.
Figure 5:
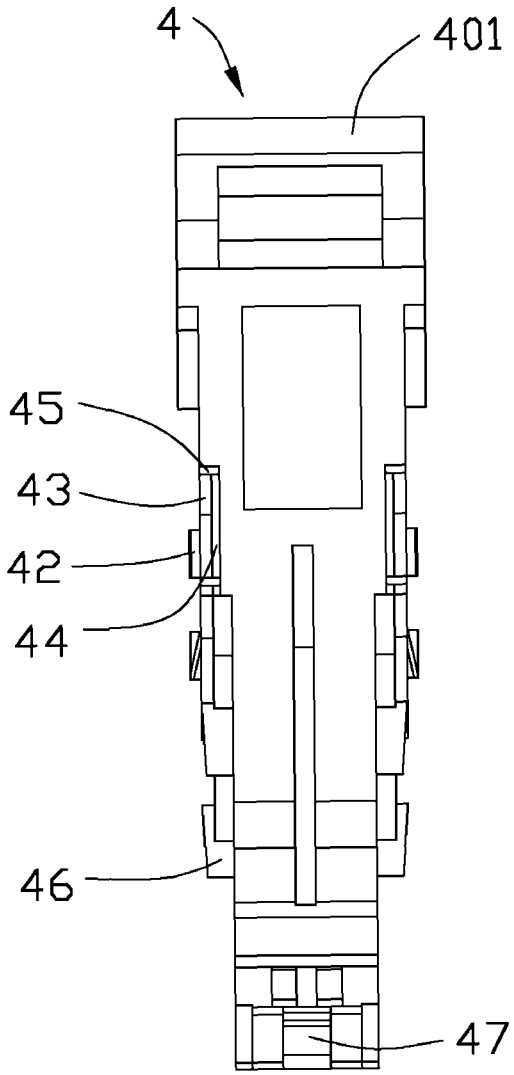
FIG. 5 is a lateral side elevational view of the ejector mechanism of the card edge connector shown in FIG. 1.
Figure 6:
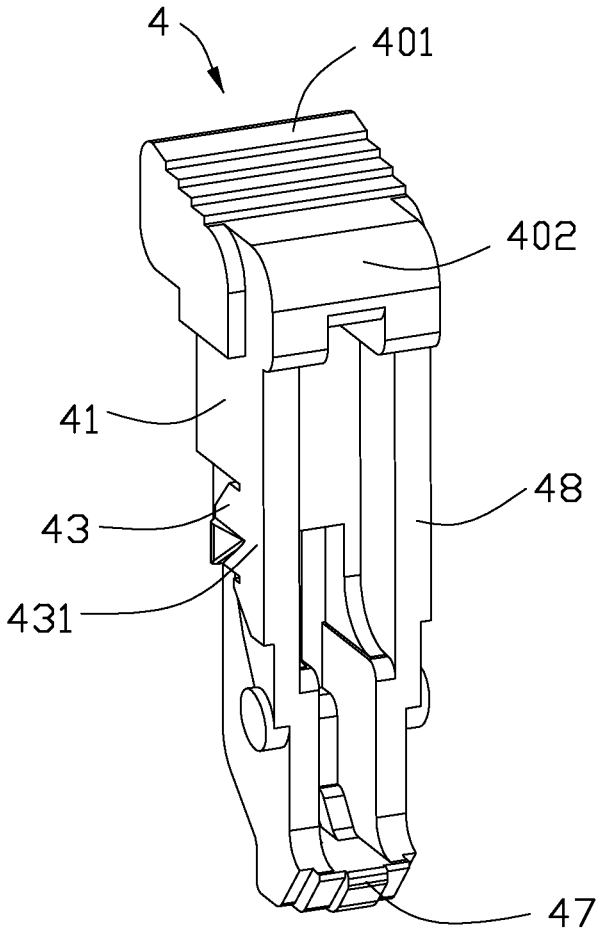
FIG. 6 is a view similar to FIG. 4, while taken from a different aspect.
Figure 7:
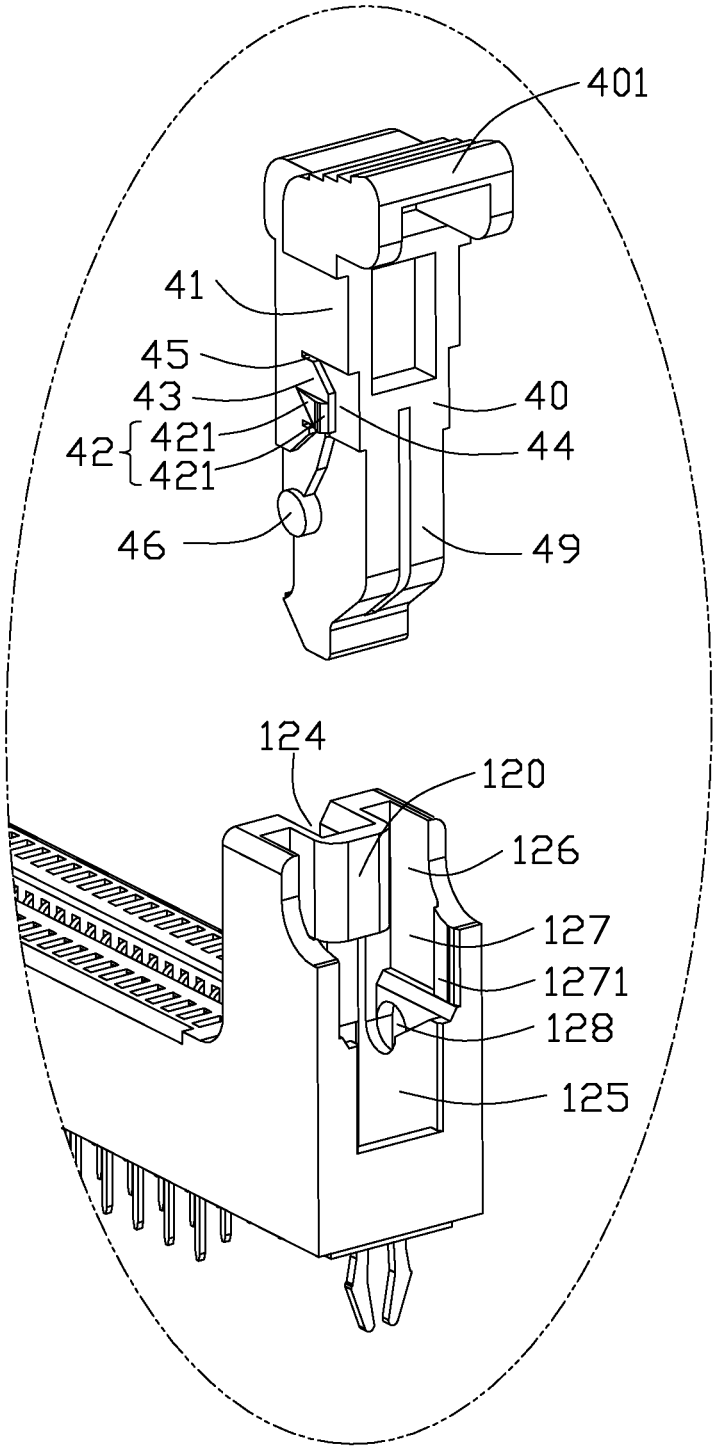
FIG. 7 is a partly enlarged view of the card edge connector shown in FIG. 1.

Referring to FIGS. 1-3, the housing 1 has an elongated base portion 11 extending along a lengthwise direction of the card edge connector 100, and a pair of tower portions 12 located on two ends of the base portion 11. The base portion 11 defines an upper mating surface 111 for mating with the memory card 200, a mounting surface 112 opposited to the mating surface 111 for mounting onto a mother board, and a pair of side walls 113 between the mating surface 111 and the mounting surface 112. A central slot 114 is recessed between the pair of side walls 113 and extends along the lengthwise direction for insertion of the memory card 200. In addition, the central slot 114 is disposed between the pair of the tower portions 12. The housing 1 is formed with a key portion 116 to divide the central slot 114 into two parts with different lengths for preventing the memory card 200 from mis-mating.

The side walls 113 each has a row of passageways 115 communicating with the centrals slot 114 and passing through the mating surface 111 and the mounting surface 112 along an upper-to-lower direction. The contacts 2 are divided into two rows and each has a locating portion 22 retained in the corresponding passageways 115, an elastic contact portion 21 extending into the central slot 114 from the locating portion 22, and a soldering tail 23 extending beyond the mounting surface 112 of the housing 1 from the locating portion 22.

Referring to FIGS. 3-7, each of the pair of tower portions 12 has an inner end surface 121 adjacent to the central slot 114, an outer end surface 122 opposited to the inner end surface 121 in the lengthwise direction, and an upper surface 123 between the inner end surface 121 and the outer end surface 122. The tower portions 12 each further has a pair of retention walls 126 opposited to each other in a width direction of the housing 1 to define a receiving slot 124 and an U-shaped structure retaining cavity 125 therebetween. The receiving slot 124 is recessed from the inner end surface 121 in the lengthwise direction and adapted for retaining a side edge of the memory card 200. The retaining cavity 125 is recessed inwardly from the outer end surface 122 in the lengthwise direction. A reinforcement wall 120 is formed between the receiving slot 124 and the retaining cavity 125 for limiting a movement of the memory card 200 in the lengthwise direction. A bottom of the retaining cavity 125 is under the reinforcement wall 120 and communicates with the central slot 114. The retention walls 126 each has a guiding slot 127 communicated with the retaining cavity 125, a pivot hole 128 under the guiding slot 127, and a vertical stop block 1271 surrounding the guiding slot 127 and being closed to outer end surface 122.

The board locks 3 each includes a retaining portion 31 retained in the bottom of the housing 1, and a pair of hook tails 32 downwardly extending from the retaining portion 31 and being for latching with a corresponding through hole defined in the mother board.

The ejector mechanism 4 is rotatably retained in the retaining cavity 125, and has a body portion 40, a pair of lateral walls 41, an inner wall 48 disposed at an inner side of the body portion 40, and an outer wall 49 disposed at an outer side of the body portion 40. The inner wall 48 is opposited to the outer wall 49 in the lengthwise direction. The lateral walls 41 each has a spindle 46 is rotatably received in the corresponding pivot hole 128. The eject mechanism 4 has an operating portion 401 and a locking head 402 oppositely extending from a top end of the body portion 40 in the lengthwise direction, and an ejecting portion 47 inwardly extending to the receiving slot 124 from a lower end of the body portion 40.

Two lateral sides of the body portion 40 each has a flexible arm 43 divided from the lateral wall 41 to form a space 44 between the flexible arm 43 and the lateral wall 41 in the width direction and extending toward the outer wall 49. The flexible arm 43 is disposed on a middle portion of the body portion 40 between the inner end wall 48 and the outer end wall 49 in the lengthwise direction. A locking protrusion 42 is formed at a distal end of the flexible arm 43. The flexible arm 43 is composed of a connecting end 431 connecting to the lateral wall 41, and a floating end 432. The body portion 40 further defines a pair of slits 45 disposed at an upper side and a lower side of the flexible arm 43, respectively. The slits 45 extend along the lengthwise direction, and are disposed between the lateral wall 41 and the flexible arm 43 in the upper-to-lower direction.

During the memory card 200 is being downwardly inserted into the central slot 114, a bottom end presses onto the ejecting portion 47 of ejector mechanism 4 to push the ejector mechanism 4 to rotate inwardly, the stop block 1271 of the tower portion 12 inwardly abuts against the locking protrusion 42 to urge the flexible arm 43 to be deflected toward the space 44. Thus, it could have a lower friction between the locking protrusion 42 and the stop block 1271 for decrease attrition of the locking protrusion 42 and the stop block 1271. Finally, the locking protrusion 42 passes the stop block 1271 with the friction to be locked into guiding slot 127. The locking protrusion 42 is configured as a triangle shape viewed in the width direction for decreasing the contact area between the locking protrusion 42 and the stop block 1271 while one vertex of the triangle is much closer to the central slot 114 than another two vertexes. The locking protrusion 42 also defines a rounding surface 421 engaging with the stop block 1271 so that the ejector mechanism 4 would be not easily opened while the locking head 402 locking with the memory card 200, and an inclined surface 422 extending from the rounding surface 421 toward the inner end wall 48 for guiding the locking protrusion 42 in the guiding slot 127.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, comprising:

an elongated housing extending along a longwise direction thereof and having a pair of opposed side walls, a central slot between the side walls for receiving a memory card, and a tower portion disposed at one end thereof, the tower portion defining a pair of retention walls opposited to each other in a width direction to define a retaining cavity therebetween;

a plurality of contacts retained in the housing and exposed to the central slot; and an ejector mechanism rotatable retained in the retaining cavity, the ejector mechanism having a body portion, an operating portion and a locking head oppositely extending from a top end of the body portion in the lengthwise direction, respectively, and an ejecting portion inwardly extending from the body portion, the body portion has a flexible arm, and a locking protrusion located on the flexible arm and outwardly resisting the retention wall during the ejector mechanism rotating with respect to the housing, wherein the flexible arm extends outwardly in the lengthwise direction.

2. The card edge connector as claimed in claim 1, wherein the body portion comprises a pair of lateral walls opposite to each other in the width direction, an inner wall disposed at an inner side of the body portion and an outer wall disposed at an outer side of the body portion and opposite to the inner wall, the flexible arm is received in the retaining cavity.

3. The card edge connector as claimed in claim 2, wherein the flexible arm is divided from the lateral wall and extends in the lengthwise direction to form a space between the flexible arm and the lateral wall in the width direction, the flexible arm is deflectable toward the space.

4. The card edge connector as claimed in claim 2, wherein the flexible arm is located at a middle portion of the body portion in the lengthwise direction and has a connecting end connecting to the lateral wall, and a floating end with the locking protrusion, the locking protrusion protrudes outwardly toward the retention wall.

5. The card edge connector as claimed in claim 1, wherein the body portion defines a pair of slits extending in the lengthwise direction and disposed at a top side and a lower side of the flexible arm, respectively, the slits are disposed between the lateral wall and the flexible arm in an upper-to-lower direction, respectively.

6. The card edge connector as claimed in claim 2, wherein the retention wall defines a guiding slot for leading the ejector mechanism to be retained into the retaining cavity, and a stop block surrounding an outer side of the guiding slot in the lengthwise direction, the locking protrusion locks with the guiding slot.

7. The card edge connector as claimed in claim 6, wherein the locking protrusion is configured as a triangle shape viewed in the width direction for decreasing a contact area between the locking protrusion and the stop block and one vertex of the triangle is much closer to the central slot than another two vertexes.

8. The card edge connector as claimed in claim 7, wherein the locking protrusion defines a rounding surface abuting against the stop block in the lengthwise direction so that the ejector mechanism will be not easily rotated to eject the memory card, and an inclined surface extending from the rounding surface toward the inner end wall for guiding the eject mechanism to easily rotate for locking with the memory card.

9. A card edge connector for receiving a memory card, comprising:

an elongated housing defining a central slot extending along a lengthwise direction thereof, and two tower portions located at two opposite ends thereof;

two rows of contacts disposed by two sides of the central slot, respectively;

a pair of ejector mechanisms rotatably disposed in the corresponding tower portions, respectively, each of the ejector mechanisms defining at least one flexible arm extending in the lengthwise direction, and at least one locking protrusion located on the flexible arm and extending toward a first direction perpendicular to the lengthwise direction; and a pair of stop blocks formed in the tower portion and extending toward a second direction opposite to the first direction and perpendicular to the lengthwise direction, the stop blocks being disposed at two opposite lateral outsides of the ejector mechanism;

wherein the flexible arm is configured with enough deflection to allow the locking protrusion to pass the stop block in the lengthwise direction when the ejector mechanism is rotated to an upstanding position, wherein the flexible arm grows outwards from one lateral surface of the ejector mechanisms.

10. The card edge connector as claimed in claim 9, wherein the ejector mechanism includes a pair of lateral walls opposited to each other in the first direction, the flexible arms is disposed on the lateral wall and extends in the lengthwise direction, the locking protrusions is located at a distal end of the flexible arm, the flexible arm is deflected toward the lateral wall when abutting against the stop block.

11. The card edge connector as claimed in claim 10, wherein the ejector mechanism each has a body portion, an operating portion and a locking head oppositely extending from a top end of the body portion in the lengthwise direction, and an ejecting portion inwardly extending from the body portion, the flexible arm is located in a middle portion of the body portion in the lengthwise direction, the locking protrusion is presented as a triangle shape viewed in the first direction, and one vertex of the triangle is much closer to the central slot than another two vertexes.

12. The card edge connector as claimed in claim 11, wherein the tower portion has a pair of retention walls opposite to each other in the first direction to form a retaining cavity therebetween to receiving the ejector mechanism therein, the retention walls each has a guiding slot located an inner side of the stop block for guiding the ejector mechanism into the retaining cavity, the locking protrusion moves into the guiding slot after a friction between the locking protrusion and the stop block.

13. A card edge connector for use with a memory module, comprising:

an insulative elongated housing defining a pair of tower portions at two opposite ends with therebetween an receiving slot in a lengthwise direction for receiving said memory module;

a plurality of contacts disposed in the housing exposed toward the receiving slot; and a pair of ejectors respectively disposed in the corresponding tower portions, each of said ejector being pivotally mounted to the corresponding tower portion and moveable between an inner locked position and an outer unlocked position; wherein one of the ejector and the corresponding tower portion is equipped with a flexible retention arm to lock to an immovable portion of the other under condition that the flexible retention arm is engaged with said immovable portion in said lengthwise direction for retaining the ejector in the inner locking position while the flexible retention arm is deflectable in a transverse direction perpendicular to said lengthwise direction to have the flexible retention arm disengaged from the immoveable portion so as to allow the ejector to be moved from the locked position to the unlocked position for releasing the memory module from the housing; wherein said flexible retention arm extends outwardly in the lengthwise direction.

14. The card edge connector as claimed in claim 13, wherein the flexible retention arm is formed on the ejector to be deflected inward.

15. The card edge connector as claimed in claim 14, wherein the flexible retention arm is located on a lateral side wall of the ejector, with a space therebetween in the transverse direction, so as to allow the flexible arm to be deflected toward the space.

* * * * *